US006812171B2

(12) United States Patent
Shimazaki et al.

(10) Patent No.: US 6,812,171 B2
(45) Date of Patent: Nov. 2, 2004

(54) CARBON FIBER SHEET AND PROCESS FOR PRODUCTION THEREOF

(75) Inventors: Kenji Shimazaki, Shizuoka (JP); Shintaro Tanaka, Shizuoka (JP)

(73) Assignee: Toho Tenax Co., Ltd., Tokyo (JP)

( * ) Notice: Subject to any disclaimer, the term of this patent is extended or adjusted under 35 U.S.C. 154(b) by 75 days.

(21) Appl. No.: 10/181,986

(22) PCT Filed: Nov. 21, 2001

(86) PCT No.: PCT/JP01/10186

§ 371 (c)(1),
(2), (4) Date: Jul. 24, 2002

(87) PCT Pub. No.: WO02/42534

PCT Pub. Date: May 30, 2002

(65) Prior Publication Data

US 2003/0027471 A1 Feb. 6, 2003

(30) Foreign Application Priority Data

| | | |
|---|---|---|
| Nov. 24, 2000 | (JP) | 2000-357411 |
| Jun. 26, 2001 | (JP) | 2001-193650 |
| Aug. 29, 2001 | (JP) | 2001-258917 |

(51) Int. Cl.[7] ..... B32B 9/00

(52) U.S. Cl. ..... 442/337; 442/368; 442/365; 442/179; 442/102; 442/103; 442/21; 428/408; 428/98; 428/219; 428/220; 423/447.1; 423/447.2; 264/29.1; 264/640; 264/642; 264/319

(58) Field of Search ..... 428/408, 98, 219, 428/220; 423/414, 445 R, 447.1, 447.2; 442/334, 366, 368, 305, 59, 102, 103, 179, 164, 20, 21, 337; 264/29.1, 603, 640, 641, 642, 643, 667, 239, 319

(56) References Cited

U.S. PATENT DOCUMENTS

| | | | |
|---|---|---|---|
| 3,497,318 A | | 2/1970 | Nass |
| 4,816,327 A | | 3/1989 | Binnersley et al. |
| 6,447,893 B2 | * | 9/2002 | Hanzawa et al. |
| 6,503,856 B1 | * | 1/2003 | Broadway et al. |

FOREIGN PATENT DOCUMENTS

| | | |
|---|---|---|
| GB | 1193263 | 5/1970 |
| JP | 59-173338 | 10/1984 |
| JP | 4-281037 | 10/1992 |

OTHER PUBLICATIONS

Catalog G–8844, "Matters of Fact", 1988, 6 pages.*

* cited by examiner

*Primary Examiner*—Deborah Jones
*Assistant Examiner*—Wendy Boss
(74) *Attorney, Agent, or Firm*—Oblon, Spivak, McClelland, Maier & Neustadt, P.C.

(57) ABSTRACT

A process for producing a carbon fiber sheet, which comprises allowing, as necessary, an oxidized polyacrylonitrile fiber sheet to contain 0.2 to 5% by mass of a resin, then subjecting the resin-containing oxidized polyacrylonitrile fiber sheet to a compression treatment in the thickness direction under the conditions of 150 to 300° C. and 5 to 100 MPa (10 to 100 MPa when no resin treatment is made) to obtain a compressed, oxidized fiber sheet having a bulk density of 0.40 to 0.80 g/cm$^3$ and a compression ratio of 40 to 75%, and thereafter subjecting the compressed, oxidized fiber sheet to a carbonizing treatment, which carbon fiber sheet has a thickness of 0.15 to 1.0 mm, a bulk density of 0.15 to 0.45 g/cm$^3$, a carbon fiber content of 95% by mass or more, a compression deformation ratio of 10 to 35%, an electric resistance of 6 mΩ or less and a feeling of 5 to 70 g.

6 Claims, No Drawings

CARBON FIBER SHEET AND PROCESS FOR PRODUCTION THEREOF

TECHNICAL FIELD

The present invention relates to a carbon fiber sheet obtained by carbonizing an oxidized polyacrylonitrile fiber sheet, as well as to a process for production of the carbon fiber sheet. More particularly, the present invention relates to a carbon fiber sheet which has a high carbon fiber content, is thin, has excellent shape ability, is superior in electrical conductivity of through-plane direction, and is suitable as a conductive material such as earth material, battery electrode material and the like, as well as to a process for production of the carbon fiber sheet.

This carbon fiber sheet is suitably used as an electrode material for cell or battery such as polymer electrolyte fuel cell, redox flow battery, zinc-bromine battery, zinc-chlorine battery or the like, or as an electrode material for electrolysis such as sodium chloride electrolysis or the like.

BACKGROUND ART

A study for using a sheet-like carbon material having electrical conductivity and excellent corrosion resistance, as an earth material or a battery electrode material, is being made. A carbon sheet used in such applications is required to have a small electric resistance in the through-plane direction.

When a carbon fiber sheet is used particularly as a battery electrode material, the carbon fiber sheet must per se have a small thickness and a high bulk density so as to meet the recent movement of cell or battery to smaller size and lighter weight. These properties allow the carbon material to have a reduced electric resistance in the through-plane direction.

As the carbon fiber sheet used in such applications, there have been known a molded carbon material, a carbon fiber fabric, a carbon fiber nonwoven fabric, etc.

As a molded carbon material of sheet shape and high bulk density, there is known a carbon fiber-reinforced carbon material (c/c paper) (JP No. 2584497 and JP-A-63-222078). This sheet is produced by making chopped carbon fibers into a paper, impregnating the resulting paper with a phenolic resin or the like to obtain a phenolic resin composite material, and carbonizing the phenolic resin or the like, in the phenolic resin composite material.

This sheet is produced by press molding using a mold and, therefore, is superior in thickness accuracy and surface smoothness. However, this sheet is inferior in flexibility and is impossible to make into a roll. Therefore, the sheet is unsuitable for applications where a long sheet is needed.

Further, the sheet is fragile and easily broken owing to, for example, the impact applied during the transportation or processing. Furthermore, the sheet has a high production cost and, when used in a large amount as a conductive material, is expensive. The reason why the carbon fiber-reinforced carbon sheet is fragile and inferior in flexibility, is that the sheet contains the carbonization product of the impregnated resin in a large amount.

In order to obtain a sheet of flexibility and yet high bulk density, it is necessary to make high the content of carbon fiber in sheet.

As a sheet-shaped carbon material with flexibility, a carbon fiber fabric is known. As such a fabric, there is a filament fabric (JP-A-4-281037 and JP-A-7-118988) and a spun yarn fabric (JP-A-10-280246).

One of the features of these fabrics is that they have such flexibility as they can be made into a roll and that they are easily handled when stored or used as a long product.

The filament fabric is obtained by weaving a carbon fiber strand into a fabric. The number of the carbon fibers constituting the carbon fiber strand can be various. In the filament fabric, the direction of the carbon fiber axis is basically parallel to the in-plane direction of the fabric. Therefore, the electric resistance of the fabric is low in the in-plane direction but high in the through-plane direction.

Meanwhile, as the spun yarn fabric, there is known a carbon fiber spun yarn fabric obtained by producing an oxidized polyacrylonitrile (PAN) fiber fabric using an oxidized PAN fiber spun yarn and carbonizing it. This carbon fiber spun yarn fabric is generally more flexible than the carbon fiber filament fabric. Further, since being obtained by twisting short fibers, the spun yarn fabric is expected to have a lower electric resistance in the through-plane direction than the carbon fiber filament fabric. Furthermore, the spun yarn fabric has a lower production cost than the above-mentioned C/C paper.

However, conventional carbon fiber spun yarn fabrics are generally low in bulk density. Therefore, they show a high electric resistance in the through-plane direction in applications requiring conductivity, such as electrode and the like, although the electric resistance is lower than that of the C/C paper.

As the spun yarn fabric, there was also proposed a carbon fiber fabric obtained by cutting a PAN-derived carbon fiber into a given length cut fiber and weaving the cut fiber into a fabric (JP-A-10-280246). This fabric, however, has a low bulk density. Compression of this fabric for higher bulk density results in a finely ground material.

As a carbon fiber sheet having flexibility and good handle ability equivalent to those of the carbon fiber fabric, there is a carbon fiber nonwoven fabric. This nonwoven fabric, when subjected to punching, shows a higher shape retain ability than the C/C paper and the carbon fiber fabric, and is produced more easily and at a lower cost than the C/C paper and the carbon fiber fabric. In general, the carbon fiber nonwoven fabric is obtained by subjecting an oxidized PAN fiber to a water jet treatment, a needle punching treatment, etc. to produce an oxidized fiber nonwoven fabric and carbonizing the oxidized fiber nonwoven fabric; therefore, in the carbon fiber nonwoven fabric, the proportion of the fiber whose axis is parallel to the through-plane direction, is larger than in the carbon fiber-reinforced carbon fiber. As a result, the carbon fiber nonwoven fabric is expected to have smaller electric resistance in the through-plane direction than that of the carbon fiber-reinforced carbon sheet.

However, since conventional oxidized fiber nonwoven fabrics are generally low in bulk density, the carbon fiber nonwoven fabric obtained by carbonizing such an oxidized fiber nonwoven fabric has a high electric resistance in the through-plane direction when used in applications such as electrode and the like.

In, for example, JP-A-9-119052 is described a process for producing an oxidized fiber nonwoven fabric, which comprises a making a web using an oxidized PAN fiber and subjecting the web to a water jet treatment. The nonwoven fabric obtained by this process has a low bulk density.

National Publication of International Patent Application No. 9-511802 discloses a technique of producing a fabric or a felt using a two-portion stable fiber having an inner core portion made of a thermoplastic polymer composition and an outer covering portion made of a carbonaceous material, surrounding the inner core portion. This two-portion stable fiber has a relatively low specific gravity of 1.20 to 1.32. A fabric or felt produced using this fiber has a low bulk density.

DISCLOSURE OF THE INVENTION

The present inventors made studies on the specifications of oxidized fiber spun yarn and oxidized fiber sheet and further on the application of a resin treatment or a pressurization treatment to oxidized fiber sheet. As a result, the present inventors found out that a carbon fiber sheet can be produced which has, as compared with conventional products, a high bulk density, appropriate flexibility and a low electric resistance in the though-plane direction. The above finding has led to the completion of the present invention.

The present invention aims at providing a carbon fiber sheet which is suitable as a conductive material such as earth material, battery electrode material or the like, has a high bulk density, appropriate flexibility and a low electric resistance in the through-plane direction, and is superior in shapeability; and a process for producing a such a carbon fiber sheet.

The present invention is as described below.

[1] A carbon fiber sheet having a thickness of 0.15 to 1.0 mm, a bulk density of 0.15 to 0.45 g/cm$^3$, a carbon fiber content of 95% by mass or more, a compression deformation ratio of 10 to 35%, an electric resistance of 6 mΩ or less and a feeling of 5 to 70 g.

[2] A carbon fiber sheet wherein the section of single fiber at each intersection between fibers has an oblate shape and the major axis of the section is nearly parallel to the surface of the carbon fiber sheet.

[3] A carbon fiber sheet according to the above [2], wherein at each intersection between fibers, the oblateness (L2/L1) of single fiber represented by the maximum diameter (L1) of the section of single fiber and the minimum diameter (L2) of the section of single fiber is 0.2 to 0.7.

[4] A carbon fiber sheet according to the above [2], wherein the portion other than the intersections between fibers in single fiber contains at least a part in which the oblateness (L2/L1) is more than 0.7.

[5] A process for producing a carbon fiber sheet set forth in the above [1], by subjecting an oxidized polyacrylonitrile fiber sheet to carbonizing treatment, which process comprises subjecting an oxidized polyacrylonitrile fiber sheet to a compression treatment in the thickness direction under the conditions of 150 to 300° C. and 10 to 100 MPa to obtain a compressed, oxidized fiber sheet having a bulk density of 0.40 to 0.80 g/cm$^3$ and a compression ratio of 40 to 75%, and then subjecting the compressed, oxidized fiber sheet to a carbonizing treatment.

[6] A process for producing a carbon fiber sheet set forth in the above [1], by subjecting an oxidized polyacrylonitrile fiber sheet to a carbonizing treatment, which process comprises allowing an oxidized polyacrylonitrile fiber sheet to contain 0.2 to 5% by mass of a resin, then subjecting the resin-containing oxidized polyacrylonitrile fiber sheet to a compression treatment in the thickness direction under the conditions of 150 to 300° C. and 5 to 100 MPa to obtain a compressed, oxidized fiber sheet having a bulk density of 0.40 to 0.80 g/cm$^3$ and a compression ratio of 40 to 75%, and thereafter subjecting the compressed, oxidized fiber sheet to a carbonizing treatment.

In the present invention, an oxidized fiber sheet is subjected to a compression treatment under particular conditions, whereby the oxidized fiber sheet can be preferably compression-molded and, by carbonizing the resulting material, a carbon fiber sheet can be obtained which has a high bulk density and appropriate flexibility suited for a continuous treatment. The thus-produced carbon fiber sheet has a low electric resistance in the through-plane direction and accordingly is suitable as a conductive material such as earth material, battery electrode material or the like.

BEST MODE FOR CARRYING OUT THE INVENTION

The present invention is described in detail below.

Oxidized Polyacrylonitrile Fiber

In producing the carbon fiber sheet of the present invention, the starting material is an oxidized PAN fiber.

As a PAN fiber which is a precursor of the oxidized PAN fiber, preferred is a fiber containing 90 to 98% by mass of an acrylonitrile monomer unit and 2 to 10% by mass of a comonomer unit. The comonomer can be exemplified by vinyl monomers such as alkyl acrylate (e.g. methyl acrylate), acrylamide, itaconic acid and the like.

In the present invention, the PAN fiber is subjected to a flame retardation treatment to produce an oxidized PAN fiber. The flame retardation treatment is preferably conducted by treating the PAN fiber in air at an initial oxidation temperature of 220 to 250° C. for 10 minutes, increasing the temperature of the treated PAN fiber to the maximum temperature of 250 to 280° C. at a temperature elevation rate of 0.2 to 0.9° C./min, and keeping the PAN fiber at this temperature for 5 to 30 minutes. By the above flame retardation treatment for the PAN fiber, an oxidized PAN fiber having the properties shown below can be produced.

The oxidized PAN fiber preferably has a fineness of 0.55 to 2.4 dtex. When the fineness is less than 0.55 dtex, the single fiber has a low tenacity and end breakage occurs in spinning. When the fineness is more than 2.4 dtex, no intended twist number is obtained in spinning, resulting in a spun yarn of low strength. As a result, in producing a fabric, the cutting of spun yarn and fuzz appear, making the fabric production difficult. Also when the oxidized PAN fiber is used for production of an oxidized fiber sheet such as oxidized fiber nonwoven fabric, oxidized fiber felt or the like, the oxidized PAN fiber preferably has a fineness of the above-mentioned range.

The oxidized PAN fiber may have any sectional shape such as circle, oblate shape or the like.

Specific Gravity of Fiber

The specific gravity of the oxidized PAN fiber is preferably 1.34 to 1.43. When the specific gravity is less than 1.34, the oxidized PAN fiber tends to have uneven shrinkage in the in-plane direction while it is fired. When the specific gravity is more than 1.43, the single fiber elongation thereof is small. The spun yarn produced using such a fiber has a low strength. Further, it is difficult to reduce the thickness of the oxidized fiber sheet (produced from such a spun yarn) by a compression treatment which is described later. When an insufficiently compressed oxidized fiber sheet is carbonized, it is difficult to obtain a thin carbon fiber sheet specified by the present invention.

Crimp Ratio and Crimp Number

The oxidized PAN fiber, when spun or processed into a nonwoven fabric, is subjected to crimping beforehand. In this case, the crimp ratio and crimp number of the oxidized PAN fiber are preferably 8 to 25% and 2.4 to 8.1 per cm, respectively. When the crimp ratio is less than 8%, the entanglement between fibers is low, generating end breakage during spinning. When the crimp ratio is more than 25%, the strength of single fiber is low, making spinning difficult. When the crimp number is less than 2.4 per cm, end breakage occurs during spinning. When the crimp number is more than 8.1 per cm, the strength of single fiber is low and end breakage occurs easily during crimping.

The same applies also when an oxidized fiber sheet such as oxidized fiber nonwoven fabric, oxidized fiber felt or the like is produced.

Dry Strength

The dry strength of the oxidized PAN fiber is preferably 0.9 g/dtex or more. When the dry strength is less than 0.9 g/dtex, the processability of the oxidized PAN fiber into oxidized fiber sheet is low.

Dry Elongation

The dry elongation of the oxidized PAN fiber is preferably 8% or more. When the dry elongation is less than 8%, the processability of the oxidized PAN fiber into an oxidized fiber sheet is low.

Knot Strength

The knot strength of the oxidized PAN fiber is preferably 0.5 to 1.8 g/dtex. When the knot strength is less than 0.5 g/dtex, the processability of the oxidized PAN fiber into an oxidized fiber sheet is low and the obtained oxidized fiber sheet and carbon fiber sheet are low in strength. An oxidized PAN fiber having a knot strength of more than 1.8 g/dtex is difficult to even produce.

Knot Elongation

The knot elongation of the oxidized PAN fiber is preferably 5 to 15%. When the knot elongation is less than 5%, the processability of the oxidized PAN fiber into an oxidized fiber sheet is low and the obtained oxidized fiber sheet and carbon fiber sheet are low in strength. An oxidized PAN fiber having a knot elongation of more than 15% is difficult to even produce.

When the oxidized PAN fiber is spun, the fiber preferably has an average cut length of 25 to 65 mm. When the average cut length is outside the range, end breakage tends to occur during spinning.

Production of Oxidized PAN Fiber Spun Yarn

In producing a spun yarn using the oxidized PAN fiber, first, the oxidized PAN fiber is spun according to an ordinary method to produce an oxidized PAN fiber spun yarn. Then, this spun yarn is subjected to fine spinning to produce a spun yarn constituted by a 20 to 50 count single yarn or two ply yarn of 200 to 900 times/m in second twist and first twist.

The twist of the spun yarn is preferably 200 to 900 times/m. When the twist is outside the range, the yarn strength during spinning is low, making it difficult to produce a fabric using such a spun yarn.

Production of Oxidized Fiber Sheet

In the present invention, an oxidized fiber sheet is produced using the oxidized PAN fiber or a spun yarn thereof.

The kinds of the oxidized fiber sheet can be exemplified by an oxidized fiber nonwoven fabric, an oxidized fiber felt and an oxidized fiber spun yarn fabric.

The thickness of the oxidized fiber sheet is preferably 0.3 to 2.0 mm. When the thickness of the oxidized fiber sheet is less than 0.3 mm, no sufficient compression is possible in a compression treatment to be described later, making it impossible to obtain an oxidized fiber sheet of high bulk density. When the thickness of the oxidized fiber sheet is more than 2.0 mm, the carbon fiber sheet obtained therefrom has a high electric resistance in the through-plane direction.

The bulk density of the oxidized fiber sheet is preferably 0.07 to 0.40 g/cm$^3$, more preferably 0.08 to 0.39 g/cm$^3$. When the bulk density is less than 0.07 g/cm$^3$, it is impossible to obtain a carbon fiber sheet having an intended bulk density. When the bulk density is more than 0.40 g/cm$^3$, the carbon fiber sheet obtained has a low strength and no intended flexibility.

As to the process for producing the oxidized fiber sheet, an appropriate process known to those skilled in the art can be employed.

Production of Compressed Oxidized Fiber Sheet

In the present invention, next, the oxidized fiber sheet is allowed to contain a resin as necessary. After having been allowed to contain a resin or without containing any resin, the oxidized fiber sheet is subjected to a compression treatment in the through-plane direction to obtain a compressed oxidized fiber sheet. By this compression treatment, the carbon fibers of the resulting sheet can have oblateness at the intersections between carbon fibers, as described later.

When the oxidized fiber sheet is allowed to contain a resin, as compared with when it contains no resin, the compression treatment is easier and there can be obtained a compressed oxidized fiber sheet which is thinner and has a higher bulk density. In general, a compressed oxidized fiber sheet expands slightly in the through-plane direction during its carbonization stage described later. This expansion can be minimized by the presence of a resin in the oxidized fiber sheet before compression. The presence of a resin in the oxidized fiber sheet before compression suppresses the expansion of the compressed oxidized fiber sheet and gives a carbon fiber sheet which is thinner and has a higher bulk density.

As the method for allowing the oxidized fiber sheet to contain a resin, there can be mentioned, for example, a method of immersing the oxidized fiber sheet in a resin bath of given concentration and then drying the resulting resin-containing oxidized fiber sheet. The content of the resin is preferably 0.2 to 5.0% by mass, more preferably 0.3 to 4.0% by mass relative to the oxidized fiber sheet. When the resin content is less than 0.2% by mass, there is no effect of resin addition. When the resin content is more than 5.0% by mass, the product from the carbonizing stage after the compression stage is hard and has no flexibility and a fine powder is generated. The concentration of the resin bath is, for example, 0.1 to 2.5% by mass.

The resin allows the oxidized PAN fibers to adhere to each other during the compression treatment and minimizes the expansion of the oxidized fiber sheet. As the resin, there can be mentioned, for example, thermoplastic resins such as polyvinyl alcohol (PVA), polyvinyl acetate, polyester, polyacrylic acid ester and the like; thermosetting resins such as epoxy resin, phenolic resin and the like; cellulose derivatives such as carboxy methyl cellulose (CMC) and the like. Of these resins, particularly preferred are PVC, CMC, an epoxy resin and a polyacrylic acid ester, all having a high viscosity and a high adhesivity during the compression treatment. The resin bath is a solution of a resin in an organic solvent or a dispersion of a resin in water.

As the method for subjecting the oxidized fiber sheet to a compression treatment, there can be mentioned, for example, a method of compressing the oxidized fiber sheet using a hot press, a calender roller or the like.

The temperature of the compression treatment is preferably 150 to 300° C., more preferably 170 to 250° C. When the compression temperature is less than 150° C., the compression treatment is insufficient, making it impossible to obtain a compressed oxidized fiber sheet of high bulk density. When the compression temperature is higher than 300° C., the resulting compressed oxidized fiber sheet has a reduced strength.

The pressure of the compression treatment is preferably 10 to 100 MPa, more preferably 15 to 90 MPa when there is no resin treatment. When the compression pressure is less than 10 MPa, the compression is insufficient, making it impossible to obtain a compressed oxidized fiber sheet of high bulk density. When the compression pressure is more than 100 MPa, the compressed oxidized fiber sheet is damaged and has a reduced strength. As a result, it is difficult to fire the compressed oxidized fiber sheet continuously. When there is a resin treatment, the resin shows an adhesive action and suppresses the expansion of oxidized fiber sheet; therefore, the resin-treated oxidized fiber sheet can give a carbon fiber sheet of intended bulk density even at a treatment pressure lower than used when there is no resin treatment. The pressure of the compression treatment when there is a resin treatment, is preferably 5 to 100 MPa.

The time of the compression treatment of the oxidized fiber sheet is preferably 3 minutes or less, more preferably 0.1 second to 1 minute. With a compression treatment of longer than 3 minutes, no further compression is achieved and the damage of fiber increases.

The compression ratio is preferably 40 to 75%.

The ratio of compression, i.e. C is defined by the following formula wherein ta refers to the thickness of oxidized fiber sheet before compression and tb refers to the thickness of oxidized fiber sheet after compression.

$$C(\%)=100\times tb/ta$$

The atmosphere of the compression treatment is preferably air or an inert gas atmosphere such as nitrogen or the like.

The thus-produced compressed oxidized fiber sheet has a bulk density of preferably 0.40 to 0.80 g/cm$^3$, particularly preferably 0.50 to 0.70 g/cm$^3$. When the bulk density is less than 0.40 g/cm$^3$, the carbon fiber sheet produced from such a compressed oxidized fiber sheet has a low electrical conductivity. When the bulk density is more than 0.80 g/cm$^3$, such a compressed oxidized fiber sheet is hard and has no appropriate flexibility, making difficult the carbonization treatment thereof.

Owing to the above compression treatment, each fiber of the compressed oxidized fiber sheet is oblate at each intersection between fibers. At each intersection between fibers, of the compressed oxidized fiber sheet, the major axis of the section of each fiber is nearly parallel to the surface of the compressed oxidized fiber sheet.

Production of Carbon Fiber Sheet

In the present invention, next, the compressed oxidized fiber sheet produced by the above method is carbonized while applying a compression pressure or without applying such a pressure, to obtain a PAN-derived carbon fiber sheet.

The carbonizing is conducted by heating the compressed oxidized fiber sheet in an inert gas atmosphere such as nitrogen, helium, argon or the like at 1,300 to 2,500° C. The temperature elevation rate up to the time when the above heating temperature is reached, is preferably 200° C./min or less, more preferably 170° C./min or less. When the temperature elevation rate is more than 200° C./min, the growth rate of the X-ray crystal size of carbon fiber is high; however, the strength of carbon fiber is low and the carbon fiber tends to generate a large amount of a fine powder.

The time of heating the compressed oxidized fiber sheet at 1,300 to 2,500° C. is preferably 30 minutes or less, particularly preferably about 0.5 to 20 minutes.

Carbon Fiber Sheet

In the thus-produced carbon fiber sheet, the thickness is 0.15 to 1.0 mm; the bulk density is 0.15 to 0.45 g/cm$^3$, preferably 0.21 to 0.43 g/cm$^3$; and at least at each intersection between carbon fibers, each carbon fiber is oblate. This oblate shape is formed during the compression treatment of the oxidized fiber sheet. Owing to that each carbon fiber has an oblate shape at the each intersection between carbon fibers, the carbon fiber sheet has appropriate flexibility, a high bulk density and a low electric resistance.

At each intersection between carbon fibers, the major axis of the section of each carbon fiber is nearly parallel to the surface of the carbon fiber sheet. At the intersections between carbon fibers, the proportion of the carbon fibers whose sectional major axes make an angle of 30° or less with the surface of the carbon fiber sheet, is ordinarily 60% or more, preferably 80% or more.

The oblateness (L2/L1) of each carbon fiber constituting the carbon fiber sheet of the present invention is preferably 0.2 to 0.7 at each intersection between carbon fibers.

The portion of carbon fiber other than the intersections between carbon fibers may have an oblate shape or other shape but is preferably low in oblateness. Specifically, the portion of the carbon fiber sheet other than the intersections between carbon fibers preferably contains at least a part in which the oblateness (L2/L1) of carbon fiber is more than 0.7.

When the oblateness of carbon fiber at each intersection between carbon fibers is less than 0.2, the strength of carbon fiber is low and a fine powder is generated easily; therefore, such an oblateness is not preferred.

When the oblateness of carbon fiber at each intersection between carbon fibers is more than 0.7, it is difficult to obtain a sheet of small thickness and high bulk density; therefore, such an oblateness is not preferred.

The oblateness of carbon fiber can be determined by observing, for example, the section of carbon fiber at an intersection between carbon fibers, perpendicular to the axis of carbon fiber, using an electron microscope. The oblateness can be determined by measuring the maximum diameter (L1) and minimum diameter (L2) of the section of single fiber and making calculation of their ratio (L1/L2).

Carbon Fiber Content

The carbon fiber content in the carbon fiber sheet of the present invention is 95% by mass or more, preferably 96% by mass or more. When the carbon fiber content is less than 95% by mass, the feeling of the carbon fiber sheet is higher than the target level and the compression deformation ratio is low.

The carbon fiber content is determined by carbonizing a resin-non-treated oxidized fiber sheet and a sheet obtained by applying a resin treatment to the same oxidized fiber sheet of same mass, then measuring the masses of the two resulting carbon fiber sheets, and calculating a carbon fiber content using the following formula.

Carbon fiber content (mass %)=100×C2/C1 wherein C1 is a mass after the resin-treated oxidized fiber sheet has been carbonized, and C2 is a mass after the resin-non-treated oxidized fiber sheet has been carbonized.

Compression Deformation Ratio

The thickness deformation ratio (compression deformation ratio) of the carbon fiber sheet of the present invention is 10 to 35%.

The compression deformation ratio is calculated as described below.

A carbon fiber sheet is cut into a square of 5 cm×5 cm; the thickness of the square at a pressure of 2.8 kPa is measured; then, the thickness at a pressure of 1.0 MPa is measured; the compression deformation ratio of the carbon fiber sheet is calculated using the following formula.

Compression deformation ratio=[(B1−B2)/B1]×100 wherein B1 is a thickness at a pressure of 2.8 kPa and B2 is a thickness at a pressure of 1.0 MPa.

When the compression deformation ratio of carbon fiber sheet is smaller than 10%, the change in thickness when the carbon fiber sheet has been used in a battery or the like in contact with other member, is too small; as a result, the fitting of the carbon fiber sheet with the other member is inferior, resulting in an increase in contact resistance. Therefore, such a compression deformation ratio is not preferred.

When the compression deformation ratio of carbon fiber sheet is larger than 35%, the change in thickness is too large; as a result, when the carbon fiber sheet has been used in a battery, an inferior dimensional stability results. Therefore, such a compression deformation ratio is not preferred.

X-Ray Crystal Size

The X-ray crystal size of the carbon fiber constituting the carbon fiber sheet is preferably 1.3 to 3.5 nm. When the crystal size is less than 1.3 nm, the carbon fiber sheet has a high electric resistance in the through-plane direction. The electric resistance in the through-plane direction is 6.0 mΩ or less, preferably 4.5 mΩ or less. When the crystal size is more than 3.5 nm, the carbon fiber sheet has a high electrical conductivity and a low electric resistance in the through-plane direction. However, the carbon fiber sheet has low flexibility and high fragility, resulting in a reduction in single fiber strength and a reduction in strength of sheet per se.

Therefore, the carbon fiber sheet obtained is further processed, a fine powder is generated during the process.

The X-ray crystal size can be controlled by controlling the temperature of carbonizing and the temperature elevation rate in carbonizing.

Electric Resistance in Through-Plane Direction

The electric resistance of carbon fiber sheet in through-plane direction can be controlled by controlling the X-ray crystal size, bulk density, etc. of the carbon fiber sheet.

The electric resistance of carbon fiber sheet in through-plane direction is preferably 6.0 mΩ or less when the sheet is used as a conductive material. When the electric resistance of carbon fiber sheet in through-plane direction is larger than 6.0 mΩ and when the carbon fiber sheet is used as a conductive material, there may occur heat generation and resultant embrittlement of carbon material.

Feeling

The feeling of the carbon fiber sheet of the present invention is 5 to 70 g. When the feeling is less than 5 g, the carbon fiber sheet is too flexible and accordingly inferior in handle ability. When the feeling is more than 70 g, the carbon fiber sheet has high rigidity. As a result, the carbon fiber sheet is impossible to pass through a roller in the step after the continuous production steps of the sheet, making difficult the continuous post-treatment.

Compressive Strength

The compressive strength of the carbon fiber sheet of the present invention is preferably 4 MPa or more, particularly preferably 4.5 MPa or more. A carbon fiber sheet having a compressive strength of less than 4 MPa, when needed to be pressed using a nip roller or the like in the step after the production steps of the sheet, gives rise to cutting of sheet and generation of fine powder in the step; therefore, such a carbon fiber sheet is not preferred.

The compressive strength of a carbon fiber sheet is defined of the maximum load needed to compress the carbon fiber sheet at a rate of 1 mm/min, i.e. the yield point of load due to the breakage of carbon fiber.

Electrode Material for Polymer Electrolyte Fuel Cell

The carbon fiber sheet mentioned above is superior particularly as an electrode material for polymer electrolyte fuel cell. Description is made below on a case of using the present carbon fiber sheet as an electrode material for polymer electrolyte fuel cell.

A polymer electrolyte fuel cell is constituted by laminating several tens to several hundreds of single cell layers.

Each single cell is constituted by the following layers.

First layer: separator

Second layer: electrode material (carbon fiber sheet)

Third layer: polymer electrolyte membrane

Fourth layer: electrode material (carbon fiber sheet)

Fifth layer: separator

The formation of a single cell using the carbon fiber sheet of the present invention as an electrode material for polymer electrolyte fuel cell is conducted by producing a thin carbon fiber sheet, inserting two such sheets between two separators and a polymer electrolyte membrane, and integrating them under pressure. The pressure for integration is 0.5 to 4.0 MPa, and the electrode material is compressed by the pressure in the through-plane direction.

The carbon fiber sheet used as an electrode material has a thickness of preferably 0.15 to 0.60 mm.

When the thickness of the carbon fiber sheet is less than 0.15 mm, the sheet is low in strength and the sheet has problems in processing, such as cutting, elongation and the like appear strikingly. Further, the sheet is low in compression deformation ratio and gives no intended thickness deformation ratio of 10% or more when pressed at a pressure of 1.0 MPa.

When the thickness of the carbon fiber sheet is more than 0.60 mm, it is difficult to produce a small cell when the sheet is integrated with separators to assemble a cell.

The compression deformation ratio of the carbon fiber sheet is preferably 10 to 35%.

When the compression deformation ratio of the carbon fiber sheet is less than 10%, the damage or thickness change of polymer electrolyte membrane takes place easily; therefore, such a compression deformation ratio is not preferred.

When the compression deformation ratio of the carbon fiber sheet is more than 35%, the sheet used as an electrode material, when integrated with separators, etc. to form a single cell, fills the grooves of separator and prevents the migration of reaction gas; therefore, such a compression deformation ratio is not preferred.

The bulk density of the carbon fiber sheet is preferably 0.15 to 0.45 g/cm$^3$.

When the bulk density of the carbon fiber sheet is less than 0.15 g/cm$^3$, the carbon fiber sheet is high in compression deformation ratio, making it difficult to obtain a material having a compression deformation ratio of 35% or less.

When the bulk density of the carbon fiber sheet is more than 0.45 g/cm$^3$, the permeability of gas in electrode is low, reducing the properties of the resulting cell.

The carbon fiber sheet used as an electrode material for polymer electrolyte fuel cell must have the above-mentioned properties. The reason is that the carbon fiber sheet needs to show such an appropriate change in thickness as the sheet can exhibit a buffer action against pressure when pressed for single cell formation.

The carbon fiber sheet used as an electrode material for polymer electrode fuel cell preferably has an area weight of 30 to 150 g/m$^2$, in addition to the above-mentioned appropriate levels of thickness, bulk density and compression deformation ratio.

When the area weight of the carbon fiber sheet is less than 30 g/m$^2$, the sheet may have a low strength or a high electric resistance in the through-plane direction; therefore, such an area weight is not preferred.

When the area weight of the carbon fiber sheet is more than 150 g/m$^2$, the sheet is low in gas permeability or diffusibility; therefore, such an area weight is not preferred.

The carbon fiber sheet used as an electrode material for polymer electrode fuel cell further has a compressive strength of preferably 4.5 MPa or more and a compressive modulus of preferably 14 to 56 MPa.

When the compressive strength of the carbon fiber sheet is less than 4.5 MPa, a carbon fine powder is generated when the sheet is integrated into a single cell and pressed; therefore, such a compressive strength is not preferred.

When the compressive modulus of the carbon fiber sheet is less than 14 MPa, no intended compression deformation ratio of less than 35% is achieved; therefore, such a compressive modulus is not preferred.

When the compressive modulus of the carbon fiber sheet is more than 56 MPa, the sheet tends to have a compression deformation ratio of less than 10%; therefore, such a compressive modulus is not preferred.

EXAMPLES

The present invention is described more specifically below by way of Examples. However, the present invention is in no way restricted to these Examples. Incidentally, the properties of each carbon fiber sheet were measured according to the following methods.

<Thickness>

The thickness of an oxidized fiber sheet or a carbon fiber sheet when a load of 2.8 kPa was applied to the sheet using a circular plate of a size of 30 mm in diameter.

<Bulk Density>

An oxidized fiber sheet or a carbon fiber sheet was vacuum-dried at 110° C. for 1 hour, after which the area weight was divided by the thickness to obtain the bulk density of the sheet.

<Feeling>

A carbon fiber sheet of 100 mm in length and 25.4 mm in width is placed on a slit of W (mm) in width so that the length direction of the sheet is perpendicular to the slit. Using a metal plate of 2 mm in width and 100 mm in length, the carbon fiber sheet is forced into the slit to a depth of 15 mm at a speed of 3 mm/sec. The maximum load applied to the metal plate, necessary for the operation is taken as the feeling of the carbon fiber sheet. Incidentally, the slit width W is controlled so as to satisfy W/T=10 to 12 (T is the thickness (mm) of the carbon fiber sheet).

<Tensile Strength>

A value obtained by fixing a carbon fiber sheet of 25.4 mm in width and 120 mm or more in length to a jig having a chuck-to-chuck distance of 100 mm, pulling the carbon fiber sheet at a speed of 30 mm/min, converting the resulting breaking strength into a breaking strength of 100 mm width.

<Compressive Strength>

The maximum load required to compress a carbon fiber sheet at a speed of 1 mm/min, i.e. the yield point of load due to the breakage of carbon fiber.

<Carbon Fiber Content>

A resin-non-treated oxidized fiber sheet and a sheet obtained by applying a resin treatment to the same oxidized fiber sheet of same mass were carbonized, then the masses of the two resulting carbon fiber sheets were measured, and the carbon fiber content of carbon fiber sheet was calculated using the following formula.

Carbon fiber content (mass %)=100×C2/C1 wherein C1 is a mass after the carbonizing of the resin-treated oxidized fiber sheet and C2 is a mass after the carbonizing of the resin-non-treated oxidized fiber sheet.

<Compressive Strength and Modulus>

A plurality of same test pieces (5 cm×5 cm) of a carbon fiber sheet were laminated in a thickness of about 5 mm; the laminate was compressed at a compression speed of 100 mm/min; and the properties were measured.

<Electric Resistance in Through-Plane Resistance>

A carbon fiber sheet of 5 cm×5 cm was interposed between two plate electrodes and measured for electric resistance when a load of 10 kPa was applied.

<Test Method for Crystal Size>

Crystal size Lc was calculated from the Scherrer's formula shown below, using the data (peak in the vicinity of 2θ=26º) obtained by a measurement by a wide angle X-ray diffractometer.

$$Lc(\text{nm})=0.1k\lambda/\beta\cos\theta$$

wherein k is an apparatus constant (0.9 in the Examples and Comparative Examples), λ is an X-ray wavelength (0.154 nm), β is a half-band width in the vicinity of 2θ=26º, and θ is a peak position (º).

Test Conditions

Set tube voltage: 40 kV

Set tube current: 30 mA

Test range: 10 to 40º

Sampling interval: 0.02º scanning speed: 4º/min

Times of accumulation: once

Sample form: a plurality of same samples are laminated so that the peak intensity after base line correction becomes 5,000 cps or more.

<Specific Gravities of Oxidized PAN Fiber and Carbon Fiber>

These were measured by ethanol substitution.

<Oblateness of Carbon Fiber>

For a carbon fiber sheet, a microphotograph (magnification=5,000) of the section of carbon fiber perpendicular to fiber axis was taken at the fiber intersection and at the fiber portion other than the fiber intersection. The minimum diameter and maximum diameter of each of the sections taken were measured and calculation was made using the following formula.

Oblateness of carbon fiber=L2/L1 wherein L1 is the maximum diameter of carbon fiber section and L2 is the minimum diameter of carbon fiber section.

Incidentally, the oblateness of carbon fiber at the fiber portion other than fiber intersection is the oblateness of carbon fiber measured at a mid point between nearest two intersections.

<Core Ratio of Oxidized Fiber>

Oxidized PAN fibers aligned in one direction were fixed by a molten polyethylene or wax; then, cutting was made in a direction perpendicular to the fiber axis to prepare a plurality of fixed fiber samples of 1.5 to 2.0 mm in length. These fixed fiber samples were placed on a glass plate. By applying a light of $1.5\times10^3$ to $2.5\times10^3$ 1×, the microphotographs of the samples were taken at a 1,000 magnification from the light-applied side and the opposite side. The microphotographs taken were observed; those fixed fiber samples for which two portions, i.e. a central portion of fiber section (a light portion) and a peripheral portion of fiber section (a dark portion) could be distinguished from each other, were selected; and the diameter (L) of fiber and diameter (R) of fiber inside (light portion), of each selected sample were measured. Using these diameters, the core ratio of the oxidized PAN fiber was calculated from the following formula.

$$\text{Core ratio (\%)}=100\times(R/L)$$

Examples 1 to 6

An oxidized polyacrylonitrile fiber staple of 2.2 dtex in fineness, 1.42 in specific gravity, 4.9 per cm in crimp number, 11% in crimp ratio, 50% in core ratio and 51 mm in average cut length was spun to obtain a 34 count two ply yarn of 600 times/min in second twist and 600 times/min in first twist. Then, using this spun yarn, a plain fabric having a yarn density of 15.7 yarns/cm both in warp and weft was produced. The area weight was 200 g/m$^2$ and the thickness was 0.55 mm.

This oxidized fiber spun yarn fabric was treated or not treated with an aqueous PVA [Ghosenol GH-23 (trade name) produced by The Nippon Synthetic Chemical Industry Co., Ltd.] solution (concentration: 0.1% by mass). Each of the treated and non-treated fabrics was subjected to compression treatments at various temperatures and various pressures to produce compressed, oxidized fiber spun yarn fabrics. Then, they were carbonized in a nitrogen atmosphere at 2,000° C. for 1.5 minutes to obtain carbon fiber spun yarn fabrics having the properties shown in Table 1.

TABLE 1

| | Examples | | | | | |
|---|---|---|---|---|---|---|
| | 1 | 2 | 3 | 4 | 5 | 6 |
| PVA treatment | No | No | No | Yes | Yes | Yes |
| Amount of PVA adhered (mass %) | 0.0 | 0.0 | 0.0 | 1.0 | 1.0 | 1.0 |

TABLE 1-continued

| | | Examples | | | | | |
|---|---|---|---|---|---|---|---|
| | | 1 | 2 | 3 | 4 | 5 | 6 |
| Compression treatment | | | | | | | |
| Temperature (° C.) | | 160 | 200 | 290 | 160 | 160 | 250 |
| Pressure (MPa) | | 20 | 40 | 90 | 20 | 40 | 80 |
| Compressed oxidized PAN fiber sheet | | | | | | | |
| Thickness (mm) | | 0.38 | 0.35 | 0.32 | 0.30 | 0.27 | 0.26 |
| Bulk density (g/cm$^3$) | | 0.53 | 0.57 | 0.63 | 0.66 | 0.74 | 0.77 |
| Compression ratio (%) | | 69 | 64 | 58 | 55 | 49 | 45 |
| Carbon fiber sheet | Area weight (g/m$^2$) | 120 | 120 | 120 | 120 | 120 | 120 |
| | Thickness (mm) | 0.43 | 0.41 | 0.38 | 0.33 | 0.31 | 0.30 |
| | Bulk density (g/cm$^3$) | 0.28 | 0.29 | 0.32 | 0.36 | 0.39 | 0.40 |
| | Electric resistance (mΩ) | 2.5 | 2.0 | 1.9 | 3.7 | 3.6 | 3.4 |
| | Tensile strength (N/cm) | 140 | 100 | 60 | 110 | 90 | 70 |
| | Compressive strength (MPa) | 5.3 | 5.1 | 5.6 | 5.1 | 5.1 | 4.8 |
| | Compression deformation ratio (%) | 32 | 28 | 26 | 18 | 15 | 14 |
| | Feeling (g) | 19 | 18 | 18 | 32 | 29 | 25 |
| | Carbon fiber content (mass %) | 100 | 100 | 100 | 99.9 | 99.9 | 99.9 |
| | Crystal size (nm) | 2.4 | 2.4 | 2.4 | 2.4 | 2.4 | 2.4 |
| | Specific gravity of fiber | 1.79 | 1.79 | 1.79 | 1.79 | 1.79 | 1.79 |

Example 7

The same oxidized fiber spun yarn fabric as used in Example 1 was treated with an aqueous polyacrylic acid ester [MARBOZOL W-60D (trade name) produced by Matsumoto Yushi-Seiyaku Co., Ltd.] solution (concentration: 1% by mass) to obtain a fabric containing a resin in an amount of 3% by mass. Then, the fabric was subjected to a compression treatment of 63% in compression ratio at a temperature of 250° C. at a pressure of 50 MPa to obtain a compressed, oxidized fiber spun yarn fabric of 0.32 mm in thickness and 0.54 g/cm$^3$ in bulk density. Then, the compressed, oxidized fiber spun yarn fabric was carbonized in a nitrogen atmosphere at 1,750° C. for 2 minutes, whereby was obtained a carbon fiber spun yarn fabric having an area weight of 120 g/m$^2$, a thickness of 0.35 mm, a bulk density of 0.28 g/cm$^3$, an electric resistance in through-plane direction of 2.3 mΩ, a tensile strength of 80 N/cm, a compressive strength of 5.6 MPa, a compression deformation ratio of 21% and a feeling of 23 g. The properties of the carbon fiber spun yarn fabric are shown in Table 2.

Example 8

The same oxidized fiber spun yarn fabric as used in Example 1 was treated with an aqueous epoxy resin [DIC FINE EN-0270 (trade name) produced by Dainippon Ink and Chemicals, Incorporated] dispersion (0.6% by mass) and then dried. The amount of the resin adhered was 2% by mass. Then, the resulting fabric was subjected to a compression treatment of 50% in compression ratio at a temperature of 200° C. at a pressure of 40 MPa to obtain a compressed, oxidized fiber spun yarn fabric of 0.28 mm in thickness and 0.55 g/cm$^3$ in bulk density. Then, the compressed, oxidized fiber spun yarn fabric was carbonized in a nitrogen atmosphere at 1,750° C. for 2 minutes, whereby was obtained a carbon fiber spun yarn fabric having an area weight of 120 g/m$^2$, a thickness of 0.30 mm, a bulk density of 0.40 g/cm$^3$, an electric resistance in through-plane direction, of 3.4 mΩ, a tensile strength of 90 N/cm, a compressive strength of 4.5 MPa, a compression deformation ratio of 15% and a feeling of 23 g. The properties of the carbon fiber spun yarn fabric are shown in Table 2.

TABLE 2

| | Examples | |
|---|---|---|
| | 7 | 8 |
| Carbon fiber content (mass %) | 99.9 | 99.9 |
| Crystal size (nm) | 2.4 | 2.4 |
| Specific gravity of carbon fiber | 1.79 | 1.79 |

Example 9

The same oxidized fiber spun yarn fabric as used in Example 1 was subjected to a compression treatment of 64% in compression ratio at a temperature of 200° C. at a pressure of 40 MPa to obtain a compressed, oxidized fiber spun yarn fabric of 0.35 mm in thickness and 0.57 g/cm$^3$ in bulk density. Then, the compressed, oxidized fiber spun yarn fabric was carbonized in a nitrogen atmosphere at 1,750° C. for 2 minutes, whereby was obtained a carbon fiber spun yarn fabric having an area weight of 126 g/m$^2$, a thickness of 0.41 mm, a bulk density of 0.31 g/cm$^3$, an electric resistance in through-plane direction of 3.2 mΩ, a tensile strength of 120 N/cm, a compressive strength of 5.7 MPa, a compression deformation ratio of 31%, a feeling of 17 g, a carbon fiber content of 100%, a crystal size of 2.1 nm and a specific gravity of fiber of 1.74.

Example 10

The same oxidized fiber spun yarn fabric as used in Example 1 was subjected to a compression treatment of 64% in compression ratio at a temperature of 200° C. at a pressure of 40 MPa to obtain a compressed, oxidized fiber spun yarn fabric of 0.35 mm in thickness and 0.57 g/cm$^3$ in bulk density. Then, the compressed, oxidized fiber spun yarn fabric was carbonized in a nitrogen atmosphere at 2,250° C. for 2 minutes, whereby was obtained a carbon fiber spun yarn fabric having an area weight of 116 g/m$^2$, a thickness of 0.41 mm, a bulk density of 0.28 g/cm$^3$, an electric resistance in through-plane direction, of 1.8 mΩ, a tensile strength of 70 N/cm, a compressive strength of 4.5 MPa, a compression deformation ratio of 13%, a feeling of 23 g, a carbon fiber content of 100%, a crystal size of 3.1 nm and a specific gravity of fiber of 1.83.

Comparative Examples 1 to 4

The same oxidized fiber spun yarn fabric as used in Example 1 was treated or not treated with an aqueous PVA [Ghosenol GH-23 (trade name) produced by The Nippon Synthetic Chemical Industry Co., Ltd.] solution (concentration: 0.1% by mass). Each of the treated and non-treated fabrics was subjected to compression treatments at various temperatures and various pressures to produce compressed, oxidized fiber spun yarn fabrics. Then, they were carbonized in a nitrogen atmosphere at 2,000° C. for 1.5 minutes to obtain carbon fiber spun yarn fabrics having the properties shown in Table 3.

TABLE 3

| | | Comparative Examples | | | |
|---|---|---|---|---|---|
| | | 1 | 2 | 3 | 4 |
| PVA treatment | | No | No | No | Yes |
| Amount of PVA adhered (mass %) | | 0.0 | 0.0 | 0.0 | 1.0 |
| Compression treatment | | | | | |
| Temperature (° C.) | | No treatment | 20 | 400 | 400 |
| Pressure (MPa) | | | 1 | 150 | 150 |
| Compressed oxidized PAN fiber sheet | | | | | |
| Thickness (mm) | | 0.55 | 0.49 | 0.23 | 0.21 |
| Bulk density (g/cm$^3$) | | 0.53 | 0.57 | 0.87 | 0.95 |
| Compression ratio (%) | | 100 | 89 | 42 | 38 |
| Carbon fiber sheet | Area weight (g/m$^2$) | 120 | 120 | 120 | 120 |
| | Thickness (mm) | 0.55 | 0.54 | 0.31 | 0.23 |
| | Bulk density (g/cm$^3$) | 0.22 | 0.22 | 0.39 | 0.52 |
| | Electric resistance (mΩ) | 2.6 | 2.6 | 1.8 | 3.5 |
| | Tensile strength (N/cm) | 180 | 150 | 20 | 10 |
| | Compressive strength (MPa) | 5.8 | 5.5 | 4.2 | 3.1 |
| | Compression deformation ratio (%) | 45 | 41 | 19 | 8 |
| | Feeling (g) | 19 | 19 | 21 | 26 |
| | Carbon fiber content (mass %) | 100 | 100 | 100 | 99.9 |
| | Crystal size (nm) | 2.4 | 2.4 | 2.4 | 2.4 |
| | Specific gravity of fiber | 1.79 | 1.79 | 1.79 | 1.79 |

Comparative Example 5

An oxidized polyacrylonitrile fiber staple of 1.7 dtex in fineness, 1.41 in specific gravity, 2.9 per cm in crimp number, 14% in crimp ratio and 51 mm in average cut length was spun to obtain a 30 count two ply yarn of 400 times/m in second twist and 500 times/m in first twist. Then, using this spun yarn, a plain fabric having a yarn density of 7.1 yarns/cm both in warp and weft was produced. The area weight was 100 g/m$^2$ and the thickness was 0.51 mm. This oxidized polyacrylonitrile fiber spun yarn fabric was treated with an aqueous PVA [Ghosenol GH-23 (trade name) produced by The Nippon Synthetic Chemical Industry Co., Ltd.] solution (concentration: 0.1% by mass) to obtain a fabric containing a PVA in an amount of 0.5% by mass. The PVA-containing fabric was subjected to a compression treatment of 65% in compression ratio at a temperature of 200° C. at a pressure of 40 MPa to obtain a compressed, oxidized fiber spun yarn fabric having a thickness of 0.28 mm and a bulk density of 0.36 g/cm$^3$. Then, the compressed, oxidized fiber spun yarn fabric was carbonized in a nitrogen atmosphere at 2,000° C. for 1.5 minutes, whereby was obtained a carbon fiber spun yarn fabric having an area weight of 60 g/m$^2$, a thickness of 0.31 mm, a bulk density of 0.19 g/cm$^3$, an electric resistance in through-plane direction, of 5.8 mΩ, a tensile strength of 30 N/cm, a compressive strength of 3.2 MPa, a compression deformation ratio of 40% and a feeling of 20 g. The properties of the carbon fiber spun yarn fabric are shown in Table 4.

Comparative Example 6

An oxidized polyacrylonitrile fiber staple of 1.5 d in fineness, 1.41 in specific gravity, 3.7 per cm in crimp number, 14% in crimp ratio, 60% in core ratio and 51 mm in average cut length was spun to obtain a 40 count two ply yarn of 550 times/m in second twist and 600 times/m in first twist. Then, using this spun yarn, a plain fabric having a yarn density of 33 yarns/cm both in warp and weft was produced. The area weight was 300 g/M$^2$ and the thickness was 0.71 mm. This oxidized fiber spun yarn fabric was treated with an aqueous CMC [Celogen (trade name) produced by Daiichi Kogyo Yakuhin Co., Ltd.] solution (concentration: 0.9% by mass) to obtain a fabric containing a CMC in an amount of 3% by mass. The CMC-containing fabric was subjected to a compression treatment of 61% in compression ratio at a temperature of 250° C. at a pressure of 80 MPa to obtain an oxidized fiber spun yarn fabric having a thickness of 0.43 mm and a bulk density of 0.67 g/cm$^3$. Then, the compressed, oxidized fiber spun yarn fabric was carbonized in a nitrogen atmosphere at 2,100° C. for 2 minutes, whereby was obtained a carbon fiber spun yarn fabric having an area weight of 180 g/m$^2$, a thickness of 0.48 mm, a bulk density of 0.38 g/cm$^3$, an electric resistance in through-plane direction, of 5.7 mΩ, a tensile strength of 210 N/cm, a compressive strength of 5.3 MPa, a compression deformation ratio of 7% and a feeling of 83 g. The properties of the carbon fiber spun yarn fabric are shown in Table 4.

TABLE 4

| | Comparative Examples | |
|---|---|---|
| | 5 | 6 |
| Carbon fiber content (mass %) | 99.9 | 99.9 |
| Crystal size (nm) | 2.4 | 2.4 |
| Specific gravity of carbon fiber | 1.79 | 1.79 |

Examples 11 to 13

An oxidized polyacrylonitrile fiber staple of 2.3 dtex in fineness, 1.38 in specific gravity, 4.5 per cm in crimp number, 12% in crimp ratio, 56% in core ratio and 51 mm in average cut length was made into a nonwoven fabric. The area weight was 150 g/m$^2$ and the thickness was 0.80 mm.

The nonwoven fabric was treated or not treated with a resin and then subjected to compression treatments, as shown in Table 5, to obtain compressed, oxidized fiber nonwoven fabrics. The compressed, oxidized fiber nonwoven fabrics were carbonized in a nitrogen atmosphere at 2,000° C. to obtain carbon fiber sheets each having a compression deformation ratio of 10 to 35%.

TABLE 5

| | | Examples | | |
|---|---|---|---|---|
| | | 11 | 12 | 13 |
| Resin treatment conditions | Kind of resin | Not used | CMC | PVA |
| | Amount adhered (mass %) | 0.0 | 4.0 | 2.0 |
| Compression treatment conditions | Pressure (MPa) | 40 | 40 | 40 |
| | Temperature (° C.) | 250 | 200 | 200 |
| Compressed, oxidized PAN fiber sheet | Thickness (mm) | 0.25 | 0.32 | 0.20 |
| | Bulk density (g/cm$^3$) | 0.60 | 0.47 | 0.75 |
| | Compression ratio (%) | 31 | 40 | 25 |
| Carbon fiber sheet | Area weight (g/m$^2$) | 90 | 90 | 90 |
| | Thickness (mm) | 0.31 | 0.38 | 0.24 |
| | Bulk density (g/cm$^3$) | 0.30 | 0.25 | 0.39 |
| | Tensile strength (N/cm) | 25 | 30 | 34 |
| | Carbon fiber content (mass %) | 100 | 99.9 | 99.9 |
| | Compressive strength (MPa) | 4.6 | 4.4 | 4.3 |
| | Compression deformation ratio (%) | 18 | 15 | 13 |
| | Feeling (g) | 20 | 41 | 31 |
| | Electric resistance (mΩ) | 2.8 | 4.1 | 3.6 |
| | Crystal size (nm) | 2.4 | 2.4 | 2.4 |
| | Specific gravity of fiber | 1.79 | 1.79 | 1.79 |

Comparative Examples 7 to 9

The same oxidized fiber nonwoven fabric as used in Examples 11 to 13 was treated or not treated with a resin and then subjected to compression treatments at various temperatures and various pressures, as shown in Table 6, to obtain compressed, oxidized fiber nonwoven fabrics. Then, the compressed, oxidized fiber nonwoven fabrics were carbonized at 2,000° C. for 1.5 minutes to obtain carbon fiber nonwoven fabrics each having properties shown in Table 6.

TABLE 6

| | | Comparative Examples | | |
|---|---|---|---|---|
| | | 7 | 8 | 9 |
| Resin treatment conditions | Kind of resin | Not used | CMC | PVA |
| | Amount adhered (mass %) | 0.0 | 15.0 | 10.0 |
| Compression treatment | Pressure (MPa) | 40 | 40 | 40 |
| | Temperature (° C.) | 100 | 200 | 200 |
| Compressed, oxidized PAN fiber sheet | Thickness (mm) | 0.65 | 0.18 | 0.15 |
| | Bulk density (g/cm$^3$) | 0.23 | 0.83 | 1.00 |
| | Compression ratio (%) | 81 | 23 | 19 |
| Carbon fiber sheet | Area weight (g/m$^2$) | 90 | 90 | 90 |
| | Thickness (mm) | 0.72 | 0.19 | 0.15 |
| | Bulk density (g/cm$^3$) | 0.13 | 0.47 | 0.60 |
| | Electric resistance (mΩ) | 3.5 | 8.6 | 7.5 |
| | Tensile strength (N/cm) | 10 | 3 | 5 |
| | Compressive strength (Mpa) | 4.8 | 1.4 | 1.6 |
| | Compression deformation ratio (%) | 69 | 9 | 6 |
| | Feeling (g) | 20 | 82 | 75 |
| | Carbon fiber content (mass %) | 100 | 99.0 | 99.7 |
| | Crystal size (nm) | 2.4 | 2.4 | 2.4 |
| | Specific gravity of fiber | 1.79 | 1.79 | 1.79 |

Example 14

An oxidized polyacrylonitrile fiber staple of 2.5 dtex in fineness, 1.35 in specific gravity, 3.9 per cm in crimp number, 55% in core ratio, 11% in crimp ratio, 2.5 g/dtex in dry strength, 24% in dry elongation and 51 mm in average cut length was subjected to carding and then to a water jet method to produce a nonwoven fabric having a thickness of 1.1 mm, an area weight of 155 g/m$^2$ and a bulk density of 0.14 g/cm$^3$.

The nonwoven fabric was subjected to a continuous compression treatment using a hot metal roller. The roller temperature was 200° C., the compression pressure was 20 MPa, and the compression time was 2 seconds.

Then, the compressed, oxidized fiber nonwoven fabric having a thickness of 0.45 mm and a bulk density of 0.34 g/cm$^3$ was continuously carbonized in a nitrogen atmosphere at 1,400° C. for 1 minute.

The properties of the resulting carbon fiber nonwoven fabric are shown in Table 7.

Example 15

The same nonwoven fabric as used in Example 14 was compressed under the conditions different from those in Example 14, followed by carbonizing. The results are shown in Table 7.

Comparative Example 10

An oxidized polyacrylonitrile fiber staple of 2.5 dtex in fineness, 1.35 in specific gravity, 90% in core ratio, 4.5 per cm in crimp number, 11% in crimp ratio, 2.8 g/dtex in dry strength, 27% in dry elongation and 51 mm in average cut length was subjected to carding and then to a water jet method to produce a nonwoven fabric having a thickness of 1.1 mm, an area weight of 152 g/m$^2$ and a bulk density of 0.14 g/cm$^3$.

The nonwoven fabric was subjected to a continuous compression treatment using a hot metal roller of 370° C. at a compression pressure of 58 MPa for 10 seconds.

Then, the compressed, oxidized fiber nonwoven fabric having a thickness of 0.33 mm and a bulk density of 0.46 g/cm$^3$ was continuously carbonized in a nitrogen atmosphere at 1,400° C. for 1 minute.

The properties of the resulting carbon fiber nonwoven fabric are shown in Table 8.

The carbon fiber nonwoven fabric obtained in Comparative Example 10 had an oblateness of 0.15 at each intersection between carbon fibers (the oblateness at the fiber portion other than the intersections between carbon fibers: 0.43), and no material having an intended oblateness could be obtained. The nonwoven fabric obtained was inferior in gas permeability.

Comparative Example 11

An oxidized polyacrylonitrile fiber staple of 2.5 dtex in fineness, 1.43 in specific gravity, 15% in core ratio, 3.5 per cm in crimp number, 10% in crimp ratio, 2.1 g/dtex in dry strength, 17% in dry elongation and 51 mm in average cut length was subjected to carding and then to a water jet method to produce a nonwoven fabric having a thickness of 1.1 mm, an area weight of 160 g/m$^2$ and a bulk density of 0.15 g/cm$^3$.

The nonwoven fabric was subjected to a continuous compression treatment using a hot metal roller of 200° C. at a compression pressure of 25 MPa for 1 second.

Then, the compressed, oxidized fiber nonwoven fabric having a thickness of 0.90 mm and a bulk density of 0.11 g/cm$^3$ was continuously carbonized in a nitrogen atmosphere at 1,400° C. for 1 minute.

The properties of the resulting carbon fiber nonwoven fabric are shown in Table 8.

The carbon fiber nonwoven fabric obtained in Comparative Example 11 had a large thickness, a high electric resistance and an oblateness of 0.87 at each intersection between carbon fibers (the oblateness at the fiber portion other than the intersections between carbon fibers: 1.00); and no carbon fiber sheet having an intended oblateness could be obtained.

TABLE 7

| | | | Examples | |
|---|---|---|---|---|
| | | | 14 | 15 |
| Oxidized PAN fiber oxidized PAN fiber nonwoven fabric | Before compression | Fineness (dtex) | 2.5 | 2.5 |
| | | Specific gravity | 1.35 | 1.35 |
| | | Thickness (mm) | 1.1 | 1.1 |
| | | Area weight (g/m$^2$) | 155 | 155 |
| | | Bulk density (g/cm$^3$) | 0.14 | 0.14 |
| | Compression treatment | Temperature (° C.) | 200 | 200 |
| | | Pressure (MPa) | 20 | 15 |
| | After compression | Compression ratio | 41 | 44 |
| | | Thickness (mm) | 0.45 | 0.49 |
| | | Bulk density (g/cm$^3$) | 0.34 | 0.32 |
| Carbonization | | Atmosphere | Nitrogen | Nitrogen |
| | | Temperature (° C.) | 1400 | 1400 |
| Carbon fiber nonwoven fabric | | Area weight (g/m$^2$) | 98 | 98 |
| | | Thickness (mm) | 0.50 | 0.53 |
| | | Bulk density (g/cm$^3$) | 0.20 | 0.18 |
| | | Carbon fiber content (mass %) | 100 | 100 |
| | | Single fiber oblateness | | |
| | | Intersection | 0.32 | 0.45 |
| | | other fiber portion | 0.75 | 0.87 |
| | | X-ray crystal size (nm) | 1.6 | 1.6 |

TABLE 7-continued

| | | Examples | |
|---|---|---|---|
| | | 14 | 15 |
| | Electric resistance (Ω) | 2.5 | 2.9 |
| | Compression deformation ratio (%) | 25 | 29 |
| | Feeling (g) | 15 | 13 |

TABLE 8

| | | | Comparative Examples | |
|---|---|---|---|---|
| | | | 10 | 11 |
| Oxidized PAN fiber | | Fineness (dtex) | 2.5 | 2.5 |
| | | Specific gravity | 1.35 | 1.43 |
| | | Core ratio (%) | 90 | 15 |
| oxidized PAN fiber nonwoven fabric | Before compression | Thickness (mm) | 1.1 | 1.1 |
| | | Area weight (g/m$^2$) | 152 | 160 |
| | | Bulk density (g/cm$^3$) | 0.14 | 0.15 |
| | Compression treatment | Temperature (° C.) | 370 | 200 |
| | | Pressure (MPa) | 58 | 25 |
| | After compression | Compression ratio (%) | 30 | 74 |
| | | Thickness (mm) | 0.33 | 0.82 |
| | | Bulk density (g/cm$^3$) | 0.46 | 0.20 |
| Carbonization | | Atmosphere | Nitrogen | Nitrogen |
| | | Temperature (° C.) | 1400 | 1400 |
| Carbon fiber nonwoven fabric | | Area weight (g/m$^2$) | 95 | 103 |
| | | Thickness (mm) | 0.35 | 0.90 |
| | | Bulk density (g/cm$^3$) | 0.27 | 0.11 |
| | | Carbon fiber content (wt. %) | 100 | 100 |
| | | Single fiber oblateness | | |
| | | Intersection | 0.15 | 0.87 |
| | | other fiber portion | 0.43 | 1.00 |
| | | X-ray crystal size (nm) | 1.6 | 1.6 |
| | | Electric resistance (Ω) | 2.9 | 6.5 |
| | | Gas permeability | Inferior | Superior |
| | | Compression deformation ratio (%) | 60 | 27 |
| | | Feeling (g) | 4 | 13 |

Example 16

An oxidized PAN fiber of 2.5 dtex in fineness, 1.35 in specific gravity, 55% in core ratio, 3.9 per cm in crimp number, 11% in crimp ratio, 2.5 g/dtex in dry strength and 24% in dry elongation was cut into an average cut length of 75 mm by stretch-breaking. The cut fiber was spun to produce a spun yarn (a 40 count two ply yarn of 250 times/m in twist number). Using this yarn, an oxidized fiber spun yarn fabric was produced.

This oxidized fiber spun yarn fabric (a plain fabric, each number of warps and wefts shot: 17 per cm, thickness: 0.9 mm, area weight: 230 g/m$^2$, bulk density: 0.26 g/cm$^3$) was subjected to a continuous compression treatment at a pressure of 20 MPa for 1 second using a hot metal roller of 200° C.

Then, the compressed, oxidized polyacrylonitrile fiber spun yarn fabric (thickness: 0.45 mm, bulk density: 0.35 g/cm$^3$) was continuously carbonized in a nitrogen atmosphere at 1,400° C. for 1 minute.

The properties of the resulting carbon fiber spun yarn fabric are shown in Table 9.

TABLE 9

| | | | Example 16 |
|---|---|---|---|
| Oxidized PAN fiber | Fineness (dtex) | | 2.5 |
| | Specific gravity | | 1.35 |
| | Core ratio (%) | | 55 |
| Spun yarn fabric | Count | | 40/2 |
| | Weaving form | | Plain fabric |
| | Yarn density (shots/cm) | | 17 |
| | Thickness (mm) | | 0.9 |
| | Area weight (g/m$^2$) | | 230 |
| | Bulk density (g/cm$^3$) | | 0.26 |
| Compression treatment | Temperature (° C.) | | 200 |
| | Pressure (Mpa) | | 20 |
| | Thickness (mm) | | 0.45 |
| | Compression ratio (%) | | 50 |
| | Bulk density (g/cm$^3$) | | 0.51 |
| Carbonization | Atmosphere | | Nitrogen |
| | Temperature (° C.) | | 1400 |
| Carbon fiber-spun yarn fabric | Area weight (g/m$^2$) | | 111 |
| | Thickness (mm) | | 0.50 |
| | Bulk density (g/cm$^3$) | | 0.32 |
| | Carbon fiber content (mass %) | | 100 |
| | Single fiber oblateness | Intersection | 0.32 |
| | | Other fiber portion | 0.74 |
| | X-ray crystal size (nm) | | 1.6 |
| | Electric resistance (Ω) | | 2.5 |
| | Compression deformation ratio (%) | | 23 |
| | Feeling (g) | | 14 |

What is claimed is:

1. A carbon fiber sheet having a thickness of 0.15 to 1.0 mm, a bulk density of 0.15 to 0.45 g/cm$^3$, a carbon fiber content of 95% by mass or more, a compression deformation ratio of 10 to 35%, an electric resistance of 6 mΩ or less and a feeling of 5 to 70 g.

2. A carbon fiber sheet wherein the section of single fiber at each intersection between fibers has an oblate shape and the major axis of the section is nearly parallel to the surface of the carbon fiber sheet.

3. A carbon fiber sheet according to claim 2, wherein at each intersection between fibers, the oblateness (L2/L1) of single fiber represented by the maximum diameter (L1) of the section of single fiber and the minimum diameter (L2) of the section of single fiber is 0.2 to 0.7.

4. A carbon fiber sheet according to claim 2, wherein the portion other than the intersections between fibers in single fiber contains at least a part in which the oblateness (L2/L1) is more than 0.7.

5. A process for producing a carbon fiber sheet set forth in claim 1, by subjecting an oxidized polyacrylonitrile fiber sheet to a carbonizing treatment, which process comprises subjecting an oxidized polyacrylonitrile fiber sheet to a compression treatment in the thickness direction under the conditions of 150 to 300° C. and 10 to 100 MPa to obtain a compressed, oxidized fiber sheet having a bulk density of 0.40 to 0.80 g/cm$^3$ and a compression ratio of 40 to 75%, and then subjecting the compressed, oxidized fiber sheet to a carbonizing treatment.

6. A process for producing a carbon fiber sheet set forth in claim 1, by subjecting an oxidized polyacrylonitrile fiber sheet to a carbonizing treatment, which process comprises allowing an oxidized polyacrylonitrile fiber sheet to contain 0.2 to 5% by mass of a resin, then subjecting the resin-containing oxidized polyacrylonitrile fiber sheet to a compression treatment in the thickness direction under the conditions of 150 to 300° C. and 5 to 100 MPa to obtain a compressed, oxidized fiber sheet having a bulk density of 0.40 to 0.80 g/cm$^3$ and a compression ratio of 40 to 75%, and thereafter subjecting the compressed, oxidized fiber sheet to a carbonizing treatment.

* * * * *

UNITED STATES PATENT AND TRADEMARK OFFICE

CERTIFICATE OF CORRECTION

PATENT NO. : 6,812,171 B2
DATED : November 2, 2004
INVENTOR(S) : Kenji Shimazaki et al.

It is certified that error appears in the above-identified patent and that said Letters Patent is hereby corrected as shown below:

Column 20,
Lines 30-31, "a compression deformation ratio of 10 to 35%," should be deleted Signed and Sealed this Nineteenth Day of April, 2005

JON W. DUDAS
*Director of the United States Patent and Trademark Office*